United States Patent [19]

Bogendorfer

[11] Patent Number: 4,932,233

[45] Date of Patent: Jun. 12, 1990

[54] ROLL STAND WITH TWO OR MORE PAIRS OF ROLL HOUSINGS

[75] Inventor: Hans Bogendorfer, Düsseldorf, Fed. Rep. of Germany

[73] Assignee: SMS Schloemann-Siemag Aktiengesellschaft

[21] Appl. No.: 215,638

[22] Filed: Jul. 6, 1988

[30] Foreign Application Priority Data

Jul. 9, 1987 [DE] Fed. Rep. of Germany ..... 3722706

[51] Int. Cl.[5] ..... B21B 31/24

[52] U.S. Cl. ..... 72/248; 72/225

[58] Field of Search ..... 72/225, 248, 237, 238, 72/239

[56] References Cited

U.S. PATENT DOCUMENTS 3,098,404 7/1963 Morath et al. ..... 72/225

3,948,072 4/1976 Aramaki ..... 72/225

*Primary Examiner*—W. Donald Bray

*Attorney, Agent, or Firm*—Toren, McGeady & Associates

[57] ABSTRACT

A roll stand with two or more pairs of roll housings 1, 2, 3, 4 and respectively 7,8. Roll bearing supports are slidingly conducted between the housings of the pairs, and the housings of the pairs are connected together outside the roll bearing supports by means of cross-arms 17, 18; 19, 20 or respectively 13, 14. They can be moved in the direction of the longitudinal axes of these threaded columns through inserted pressure nuts 21, 22; 23, 24 or respectively 34, 35 and with threaded columns 1*a,* 2*a;* 3*a,* 4*a* or respectively 7*a,* 8*a,* where these threaded columns are connected with the roll stands 1, 2, 3, 4 or respectively 13, 14. The threaded columns 1*a,* 2*a;* 3*a,* 4*a* or respectively 7*a,* 8*a* are fixedly set into the roll housings 1, 2, 3, 4 or respectively 7, 8, and stand upon them. The pressure nuts 21, 22, 23, 23 or respectively 34, 35 are drivably mounted in the cross-arms 17, 18, 19,20 or 13, 14 or 36, 37.

16 Claims, 5 Drawing Sheets

ROLL STAND WITH TWO OR MORE PAIRS OF ROLL HOUSINGS

BACKGROUND OF THE INVENTION

1. Field of the Invention

The invention concerns a roll stand comprising: two or more pairs of roll housings; roll bearing supports (roll attachment pieces) that are slidingly conducted between the housings of the pairs; and cross-arms that connect these housings outside the roll bearing supports, where these cross-arms are movable, together with thread columns linked to the roll housings, in the direction of the longitudinal axis of said thread columns. This motion is effected by means of pressure nuts inserted in the cross arms.

2. Description of the Related Art

Roll stands of this type have become known especially as universal stands. Here, to create a centering adjustment motion of the horizontal roll pair, the cross-arms that are linked with the roll bearing supports of the respective roll pair have pressure nuts that are disposed in the cross-arm in such a fashion that they cannot rotate. The thread columns which have a screw connection with these pressure nuts have contrary threads at their two ends. They are brought through the roll housings of the roll stand, are mounted therein, and are equipped with drives. Due to the contrary threads, a rotary motion of the thread columns here causes a motion of the two cross-arms of the roll stand in the adjustment direction towards the rolling stock, either towards one another or away from one another.

This generic design of a roll stand only permits moving the two cross-arms simultaneously and in dependence on one another. For this reason, it can be used only for special forms of roll stands, such as universal stands. Another important disadvantage is that the roll housings must be dimensioned comparatively heavier, because of the penetration recesses for the thread columns. Also, the mounting of the threaded columns over their length requires considerable technical effort. The penetration recesses for the threaded columns require a major machining effort in the fabrication of the roll housings.

The invention is based on the aim of improving the generic construction type of the roll stand in such a fashion that it can be used for many types of roll stands, including two-high stands, and that the above-mentioned disadvantages are avoided.

SUMMARY OF THE INVENTION

This aim is achieved as follows: The threaded columns are inserted in fixed position in the roll housings and rest on the roll housings, and the pressure nuts are mounted drivably in the cross-arms. Here the drive can be effected by driving elements that are disposed on the cross-arm and that can be coupled with the pressure nuts; but according to the invention, it is also possible to use a separate additional cross-arm that is set on the threaded columns parallel or perpendicular to the cross-arm. Drive elements that can be coupled with the pressure nut are connected with this additional cross-arm. With roll stands that have support frames for the roll bearing supports of vertical rolls, where these support frames can move within the housing pairs, said support frames can form the cross-arm according to the invention. The additional cross-arms can be set on the threaded columns either in fixed position or movably.

They can have gear nuts which are mounted at the end of the threaded columns or which can be screwed on to the threaded columns, and which can be driven by the driving elements. These gear nuts can be coupled with the pressure nuts that are mounted in the cross-arm, for example, through axially-toothed slide couplings. If, in connection with the roll stand, the support frames of the roll bearing supports of the vertical rolls form the cross-arms, the pressure nuts can be disposed in the supplementary cross-arms, and their frontal sides that face away from the drive can be placed at the contact surfaces of the support frame. The side of the support frame which faces away from these contact surfaces can have slider tappets applied to it, where the slider tappets in turn have pressure means applied to them. The cross-arms and/or the supplementary, cross-arms can be designed pivotable about one of the longitudinal axes of the threaded columns and the support frames of the vertical rolls, which form the cross-arms, and/or the associated supplementary cross-arms in such a fashion that they can be lifted off the threaded columns vertically upwards. As the invention further provides, the pressure nuts in these cases are connected loosably with the cross-arm or with the support frame. In this way, when the cross-arm or the support frame is in its swung-out or lifted-off state, the pressure nuts retain their screw connection with the respective threaded column. The cross-arms or the support frames are fixed in their working position by interlock devices which act contrary to the swing-out or lift-off direction. With roll stands that are equipped with rolling stock side guiding elements, which are hinged to the roll bearing supports of the vertical rolls so that they can be loosened on one side, these can be connected, according to the invention, to the support frame of the vertical rolls which forms the cross-arm, so that they can be loosened on the other side.

The inventive design of the roll stand can not only be used for different types of stands, as has already been mentioned; it also makes it possible to use a universal stand, after removing the support frame from the roll bearing support of the vertical rolls, as a horizontal stand with a standard roll diameter. The reason for this is that the vertical cross heads which are laterally set at the roll housings with the usual types of universal stands, and which stand in the way of using such roll diameters, are not present. The horizontal roll sets with their roll bearing supports can be removed, depending on the type of design, either upwardly when the cross-arm is swung out, or laterally when the cross-arm is run appropriately far towards the top or bottom. The horizontal rolls can be adjusted independently of one another, and it is also possible to adjust the height of the stand through the adjustment of the lower horizontal rolls. Since the roll housings themselves can be kept relatively small, the result is a correspondingly small roll stand base body, which can be manufactured with little effort, and which can be equipped with cross-arms—which may sometimes be identical to one another—and with supplementary cross-arms having attachable series motors as drive units, thus additionally reducing the manufacturing expense. Especially with universal stands the roll housings are small uncomplicated cast parts, as compared with the usual designs. If small rolls are used for rolling stock having a small cross-section, a roll stand results in practice which has very great housing rigidity and very high tolerance precision, because in this case the cross-arms can be run very close to the part of the housing that carries the threaded columns. This results in short housing lengths, because the protruding lengths of the threaded columns are located outside the load frame of the roll stand.

BRIEF DESCRIPTION OF THE DRAWING

The invention will be explained in more detail by way of the embodiments shown in the drawing. The drawing shows the following.

DESCRIPTION OF THE PREFERRED EMBODIMENTS

Figure 1:
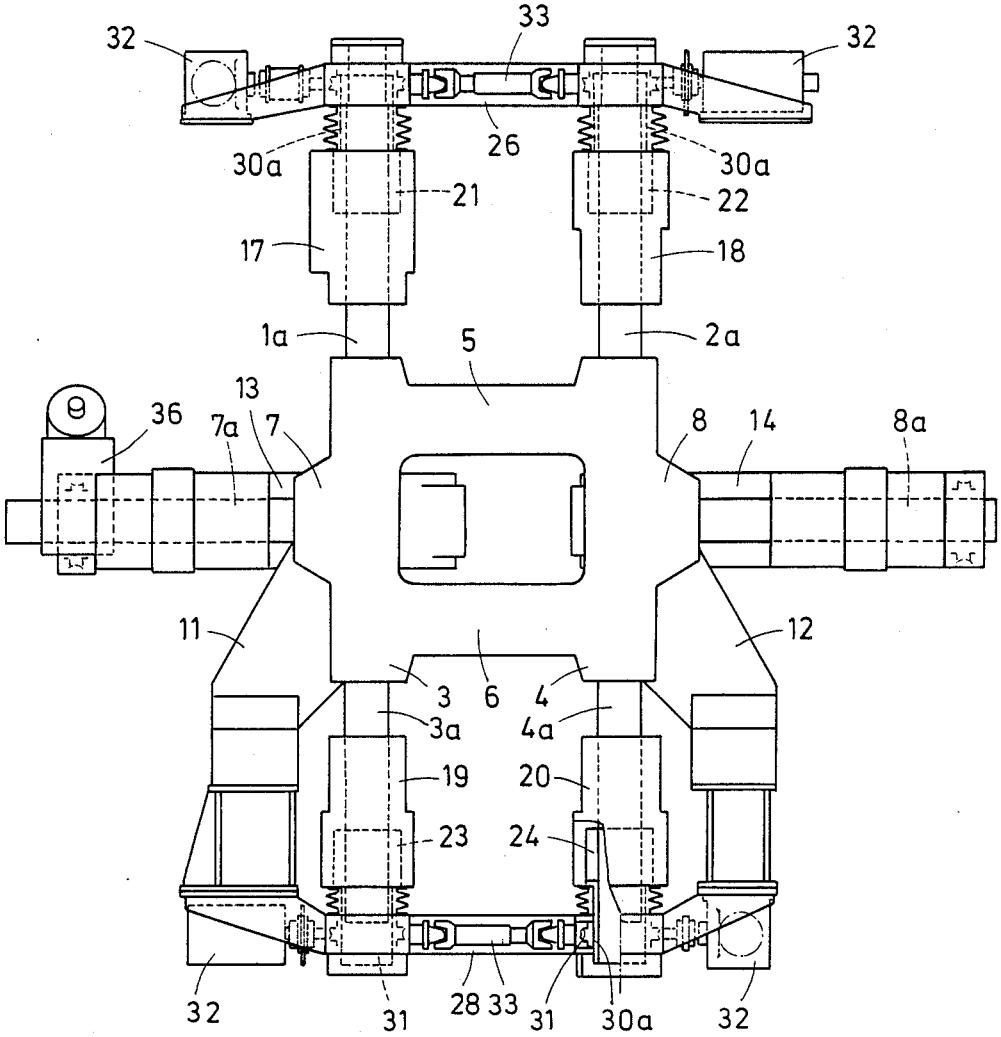
FIG. 1 shows the roll stand as viewed from the front, in a schematic representation.

The roll stand shown here is designed as a universal stand. As can be seen from FIGS. 1, 2, 3, and 4, it has upper and lower pairs of vertically running double-column housings 1, 2 and respectively 3,4 which are connected together by integrally cast upper cross-bars 5 and respectively lower cross bars 6. Furthermore, the universal stand has lateral pairs of horizontal side guiding attachments 7, 8 as well as pairs of support feet 11, 12. These parts form the basic stand. Pairs of threaded columns 1*a*, 2*a* and 3*a*, 4*a*, extending upwardly and downwardly respectively, are inserted into vertical double-column housings 1 and 2. The pairs of threaded columns 7*a* and 8*a* are inserted in fixed position into the pairs of horizontal side guiding attachments 7, 8, here extending towards both sides of the roll stand. The roll bearing supports (attachment pieces) 9 and 10 of the rolls of the horizontal roll pair 15 are guided between the columns of the double-column housing 1 and 2 (compare FIGS. 3 and 4). The support frames 13, 14 of the rolls of the vertical roll pair 16 are guided between the lateral guide attachments 7 and 8 (compare FIGS. 3, 4, and 5).

Upper cross-arms 17, 18 and lower cross-arms 19, 20 are placed on the threaded column pairs 1*a* and 2*a* respectively (FIGS. 1 and 2), so as to be longitudinally movable. Pairs of pressure nuts 21, 22 and 23, 24 are inserted into the cross-arms in such a way as to be mounted rotatably. They make a screw connection with the threaded columns 1*a*, 2*a* and 3*a*, 4*a* respectively. Above and below the cross-arms 17, 18 and 19, 20, the upper supplementary cross-arms 26, 27 and the lower supplementary cross-arms 28, 29 are disposed respectively on the threaded column pairs 1*a*, 2*a* and 3*a*, 4*a*. In the embodiment, these are always situated perpendicular to the upper cross-arms 17, 18 and the lower cross-arms 19, 20 respectively. By means of pairs of gear nuts 30 and 31, that are situated within them, they make a screw connection with the threaded columns 1a, 2*a* and 3*a*, 4*a* respectively (compare FIG. 1, lower right). The gear nuts 30, 31 are driven jointly by motors 32, disposed on the supplementary cross-arms 26, 27 and 28, 29, and by arrangements of joint couplings 33. They transfer the driving forces to the pressure nuts 21, 22 and 23, 24 which are situated in the cross-arms 17, 18 and 19, 20 respectively.

As can be seen from FIGS. 1, 2, 4, and 5, the support frames 13 and 14 of the rolls of the vertical roll pair 16 have contact surfaces 13*a*, against which the pressure nuts 34 and 35 are supported. The support frames 13 and 14 in this fashion form cross-arms which, in contrast with the upper and lower supplementary cross-arms 26, 27 and 28 29, do not make a screw connection with the thread column pairs 7*a* and 8*a*. Rather, they can be moved on the threaded columns 7*a* and 8*a*, by the pressure nuts 34 and 35, which here are mounted in the supplementary cross-arms 36, 37 themselves. The pressure nuts 34 and 35 are driven by gear nuts 38, 39, which are disposed in the supplementary cross-arms 36 and 37. These gear nuts 36, 37 are driven correspondingly with the supplementary cross-arms 26, 27 and 28, 29, by motors 40, through arrangements of joint couplings 41. The center axis of these joint couplings 41 runs between neighboring motors 40 (FIG. 3) at an inclination to the horizontal.

The driving power is transferred from the gear nuts 30, 31 and 38, 39 to the pressure nuts 21, 22, 23, and 24 and 34, 35 either directly (FIG. 2), where the gear nuts 30, 31 and 38, 39 likewise make a screw connection with the associated threaded columns 1*a*, 2*a*, 3*a*, 4*a* and 7*a*, 8*a*, or else they are mounted at their ends, and are connected with the associated pressure nuts 21, 22 and 23, 24 through slide couplings 30*a*, 31*a*, which have axial teeth (FIG. 1).

Figure 2:
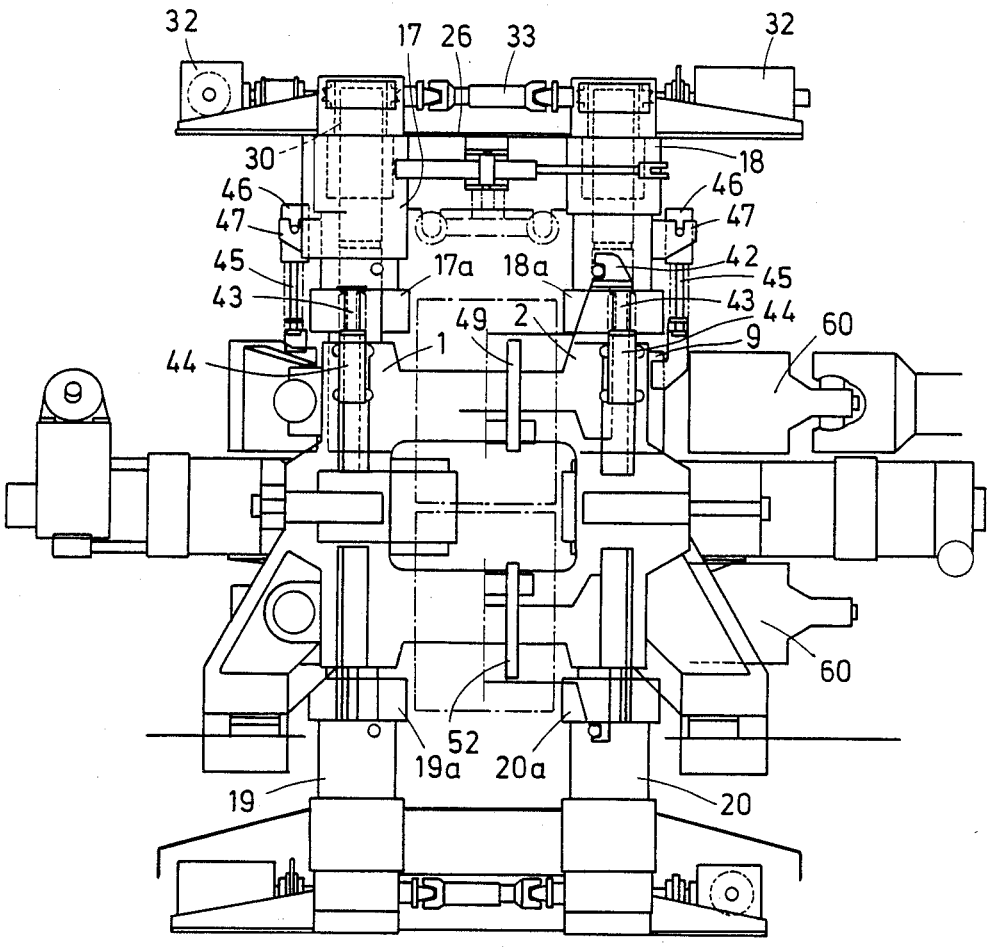
FIG. 2 shows the roll stand according to FIG. 1, in a more detailed representation.
Figure 3:
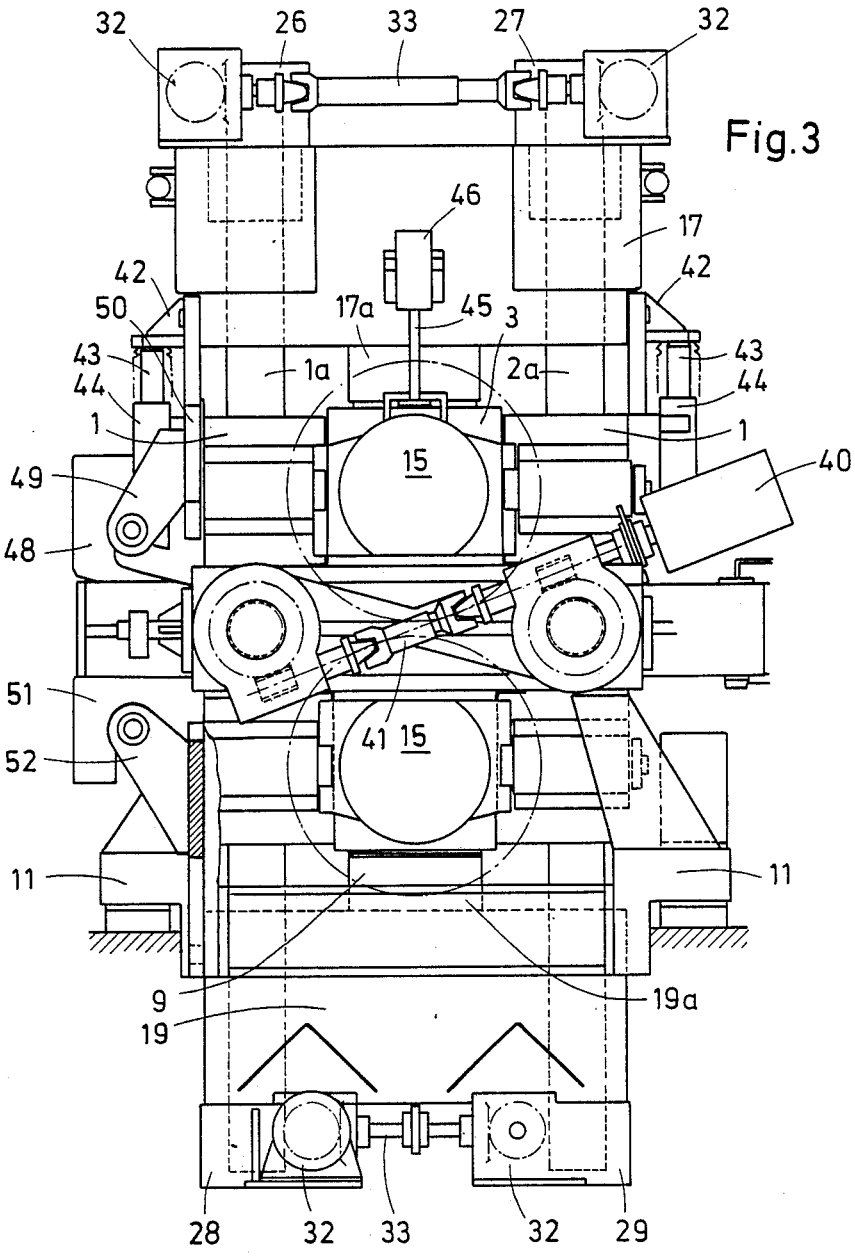
FIG. 3 is the side view of FIG. 2.

The upper cross-arms 17, 18 have lateral support attachments 42 which rest on pressure tappets 43 of the piston-cylinder units 44 which are disposed at the double column housings 1, 2 (FIGS. 2 and 3). On the other hand, the roll bearing supports 9 of the upper horizontal roll 15 are suspended at the piston rods 45 of the piston-cylinder units 46, which on their part are suspended, in such a fashion that they can be lifted out, at the support attachments 47 which are disposed at the cross-arms 17, 18. The upper and lower cross-arms 17, 18 and 19, 20 have pressure attachments 17*a*, 18*a*, and 19*a*, 20*a*, which apply pressure to the roll bearing supports 9 and 10 of the upper and lower horizontal rolls.

The upper horizontal guides 48 for the rolling stock are suspended, in well-known fashion, in pillow blocks 49 in a hinged manner. The pillow blocks are connected with the upper cross-arms 17, 18 by means of support plates 50. The lower horizontal guides 51 are placed on pillow blocks 52 in a hinged manner, which are correspondingly seated on support plates 60, which in turn are connected with the lower cross-arm 19. The vertical guides 53 for the rolling stock (compare FIGS. 3 and 4) are likewise hinged, in well-known fashion, on the one hand at the roll bearing support 54 by means of a hinge bearing 53*a*, and, on the other hand, by means of another hinge bearing 53*b*, at a push rod 56, which is guided along a guide 55, which is disposed at the lateral guide attachments 7 and 8 of the roll stand. The free end of the push rod 56 is rigidly connected with the support frames 13 and 14 of the roll bearing support 54. Furthermore, piston-cylinder units 58 with sliding tappets 57 are disposed at the lateral guide attachments 7 and 8. They act on that side of the support frame 13 and 14 that faces away from the pressure nuts 34 and 35.

The roll bearing supports 9 and 10 of the horizontal rolls 15 are acted upon from above and from below through the pressure attachments 17*a*, 18*a* and 19*a*, 20*a* of the cross-arms 17, 18 and 19, 20 respectively. They are moved in the adjustment direction when the motors 32 of the associated supplementary cross-arms 26, 27, and 28, 29 drive the pressure nuts 21, 22 and 24, 25 through the gear nuts 30, 31. The supplementary cross-arms 26, 27 and 28, 29 here follow synchronously the motion of the cross-arms 17, 18 and 19, 20 in the adjustment direction. But they can also remain fixed in an upper position, when the gear nuts 30*a*, 31*a*, as described (FIG. 1), are rotatably mounted on the ends of the threaded columns 1*a*, 2*a* and 3*a*, 4*a*, and the driving force is transferred to the pressure nuts 21, 22 and 23, 24 through axially geared slide couplings 30*a*, 31*a*. The upper horizontal roll 15 with its roll bearing supports 9 and 10 is here balanced out with respect to the cross-arms 17, 18 by means of the piston-cylinder unit 46, while the pressure tappets 43 of the piston-cylinder unit 44 support the cross-arms 17, 18 during its motions in both adjustment directions.

The two support frames 13, 14 support the vertical roll 16, and their motion in the de-adjustment directions (FIGS. 4 and 5) is caused by means of the pressure nuts 34, 35 which are mounted and disposed on the supplementary cross-arms 36, 37. Here, the pressure nuts 34, 35—since their frontal faces contact only the contact surfaces 13*a* and 14*a* of the support frames 13, 14—can drive them only in the direction towards the rolling stock, while the motions in the opposite direction are caused by the sliding tappets 57. The vertical guides 53 for the rolling stock follow these motions as a consequence of their being hinged at 53*a* at the roll bearing support 54 of the vertical roll 16 and at 53*b* at the push rod 56 that is connected with the respective support frame 13, 14.

Figure 4:
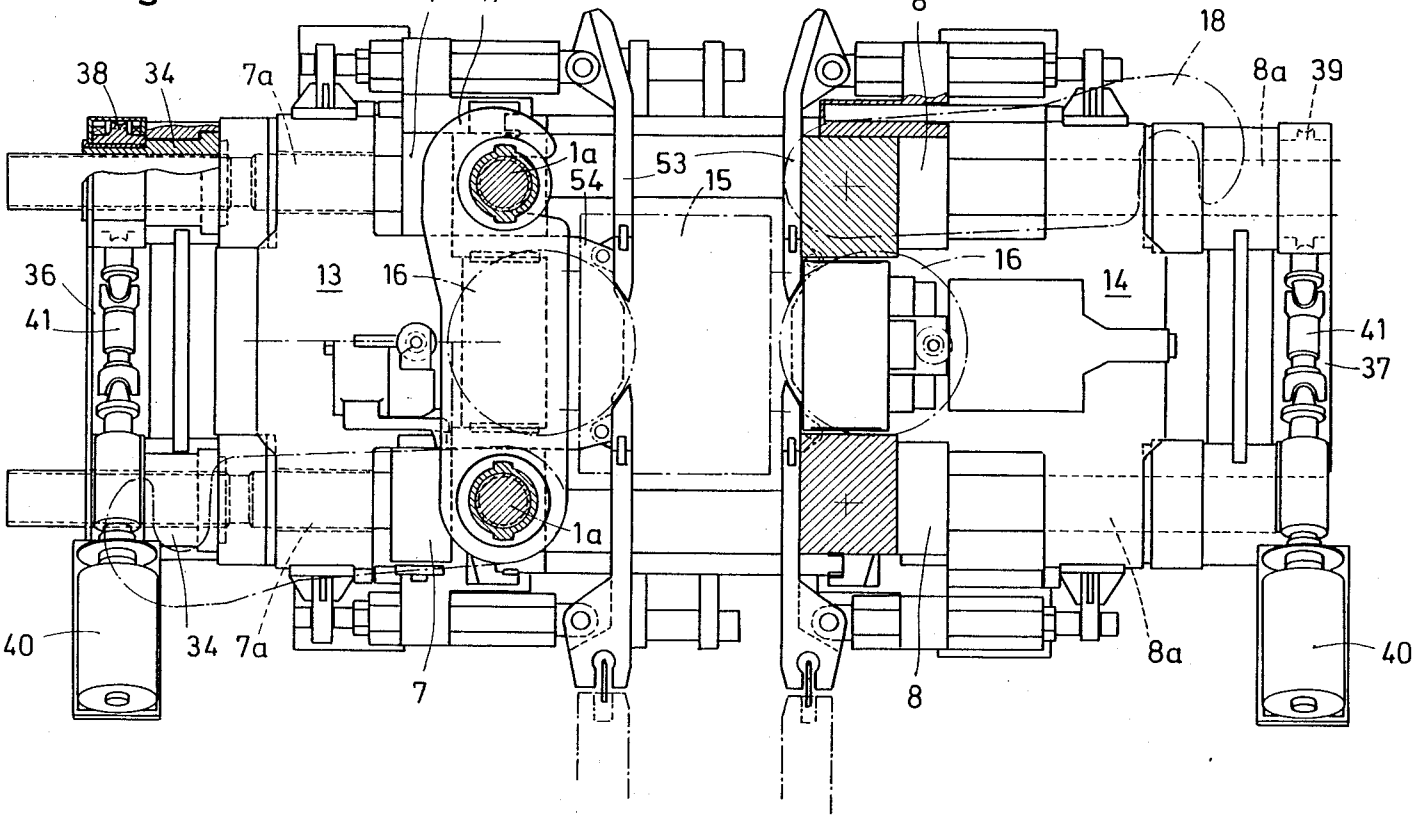
FIG. 4 is the top view of FIG. 2, partially in section
Figure 5:
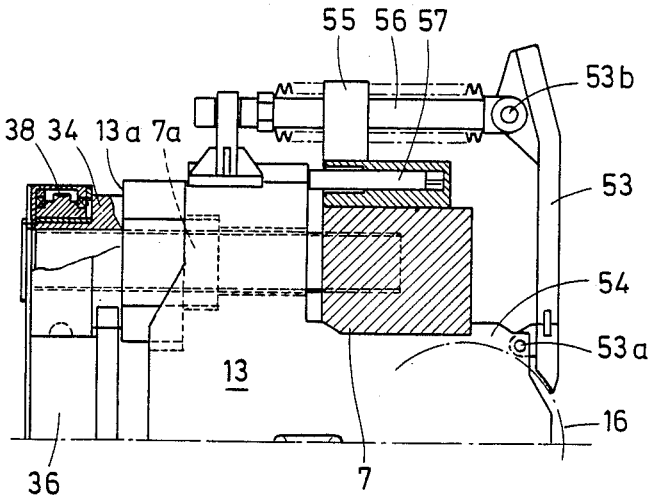
FIG. 5 is a detail from FIG. 4, partially in section.

As indicated in FIG. 4, the upper cross-arms 17 and 18 can be swung from a working position shown in solid lines (cross-arm 17) into a removal position (cross-arm 18), which is shown by dots and dashes. This permits the horizontal rolls 15, together with their roll bearing supports 9, 10, to be removed upwards. The associated pressure nuts 21, 22 here remain on the threaded columns 1*a*, 2*a*. Removal of the horizontal rolls 15 upwards, for example by means of a crane, is not hindered here by the associated supplementary cross-arms 26, 27, because, according to the invention, these lie perpendicular to the cross-arms 17, 18.

In a similar fashion (compare FIGS. 3 and 4), the support frames 13, 14, which receive the vertical roll 16, can also be removed. These can likewise be lifted off vertically upwards from the threaded columns 7*a*, 8*a*, by means of a crane. A special advantage here is that the lateral guides 53 for the rolling stock can also remain in their respective support frames 13, 14. The center axis of the joint coupling arrangement 41 between the motors 40 (compare FIG. 3) is slanted with respect to the horizontal. This makes it possible to move the supplementary cross-arms 36, 37 also in the area of the drive coupling sleeve 60, which is seated on the journal of the horizontal roll pair 15. This can be done without hindrance from their circumference.

Depending on operational and design requirements, cross-arms can also be used in connection with roll stands of the type that has been explained here, such that the driving elements for the pressure nuts are directly disposed on said cross-arms. With the described embodiment, the mounting of the pressure nuts in the supplementary cross-arm is used for the support frame of the vertical rolls. It is likewise possible to use it in connection with the supplementary cross-arms for the cross-arms which act on the horizontal rolls. The like holds for the design of the gear nuts as axially toothed slide couplings. The gear nuts can here be designed in two parts, as a worm gear connected with a slide coupling, or they can also be designed integrally.

I claim:

1. A roll stand comprising: at least two paris of roll housings and roll bearing supports, means for slidingly guiding the roll bearing supports between the housings of the pairs; and cross-arms connecting these housings outside the roll bearing supports pressure nuts being inserted in the cross-arms for moving the cross-arms together with threaded columns linked to the roll housings in the direction of the longitudinal axis of said threaded columns, the threaded columns (1*a*, 2*a*, 3*a*, 4*a* and 7*a*, 8*a*) being inserted in fixed position in the roll housings (1,2 or 7,8) and being placed on the roll housings, and the pressure nuts (21, 22, 23, 24 and 34, 35) being mounted drivably in the cross-arms (17, 18, 19, 20 and 13, 14 and 36, 37).

2. The roll stand, according to claim 1, comprising drive elements disposed on the cross-arms (17, 18, 19, 20 or 13, 14 respectively), and means for coupling the drive elements 32, 33, 30, 31, 33 or 30*a*, 31*a* or 40, 41, 38, 39) with the pressure nuts (21, 22, 23, 24 or 34, 35).

3. The roll stand, according to claim 1, comprising supplementary cross-arms (26, 27, 28, 29 or 36, 37). 29 respectively) mounted on the threaded columns (1*a*, 2*a*, 3*a*, 4*a* or 7*a*, 8*a*), and additional drive elements (24, 25 or 30, 31) connected with said supplementary cross-arms, and means for coupling the additional drive elements with the pressure nuts (14*a*, 15*a*, 16*a*, 17*a* or 12*b*).

4. The roll stand, according to claims 1 or 2, comprising support frames for the roll bearing supports of vertical rolls, the support frames being movably guided in the pairs of housings, and wherein the support frames (13, 14) form the cross-arms.

5. The roll stand, according to claim 3, wherein the supplementary cross-arms (26, 27, 28, 29 or 36, 37) are being fixedly mounted on the threaded columns (1*a*, 2*a*, 3*a*, 4*a* or 7*a*, 8*a*).

6. The roll stand, according to claim 5, comprising gear nuts (30, 31 or 38, 39 or 30*a*, 31*a*) that are mounted at the ends of the threaded columns (1*a*, 2*a*, 3*a*, 4*a* or 7*a*, 8*a*) and drive elements for driving the gear nuts (32, 33 or 40, 41 respectively), means for coupling these gear nuts with the pressure nuts (14*a*, 15, 16*a*, 7*a* or 12*b*) that are mounted in the cross-arms (17, 18, 19, 20 or 13, 14) and in the supplementary cross-arms (26, 27, 28, 29 or 36, 37).

7. The roll stand, according to claims 5 or 6, wherein the gear nuts 30*a*, 31*a*) are axially toothed slide couplings.

8. The roll stand, according to claim 7, the pressure nuts (34, 35) being disposed in the supplementary cross-arms (36, 37), the front sides of the pressure nuts that face away from the drive (40, 41) being placed on the support surfaces (13*a*, 14*a*) of the cross-arms (13, 14) and comprising slide tappets (57) for acting on that side of the cross-arms (13, 14) which faces these support surfaces (13*a*, 14*a*) and pressure means for acting on the slide tappets (57).

9. The roll stand, according to claim 3, the cross-arms (17, 18) and the supplementary cross-arms (26, 27) being pivotable about one of the longitudinal axes of the threaded columns (1*a*, 2*a*, 3*a*, 4*a*).

10. The roll stand, according to claim 4, comprising means for lifting the support frames (13 and 14), which form the cross-arms, and the supplementary cross-arms (36, 37) vertically upwards from the threaded columns (7*a*, 8*a*).

11. The roll stand, according to claim 10, the pressure nuts (21, 22) being loosably connected with the cross-arms (5, 6) or the support frames (13, 14), and comprising means for maintaining their screw connect with the respective threaded columns (1*a*, 2*a*, or respectively 7*a*, 8*a*) when the cross-arms (5, 6) or the support frames (13, 14) are swung out or lifted off.

12. The roll stand, according to claim 4, comprising vertical guiding elements for the rolling stock, the vertical guiding elements being loosely hinged at the roll bearing support of the vertical rolls and the vertical guide elements (53) for the roll stock also being loosably connected with the support frames (13, 14) which form the cross-arms.

13. The roll stand according to claim 3, wherein the supplementary cross-arms extend parallel to the respective cross-arm.

14. The roll stand according to claim 3, wherein the supplementary cross-arms extend perpendicular to the respective cross-arm.

15. The roll stand according to claim 3, wherein the supplementary cross-arms are movably mounted on the threaded columns.

16. The roll stand according to claims 5 or 6, comprising axially toothed slide couplings, the gear nuts being connected through the axially toothed slide couplings to the pressure nuts.

* * * * *